US010102812B2

(12) United States Patent
Chen

(10) Patent No.: US 10,102,812 B2
(45) Date of Patent: Oct. 16, 2018

(54) DATA PROCESSING METHOD FOR TRANSPARENT LIQUID CRYSTAL DISPLAY

(71) Applicant: Shenzhen China Star Optoelectronics Technology Co., Ltd., Shenzhen (CN)

(72) Inventor: Lixuan Chen, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 235 days.

(21) Appl. No.: 15/119,723

(22) PCT Filed: Jul. 14, 2016

(86) PCT No.: PCT/CN2016/089960
§ 371 (c)(1),
(2) Date: Aug. 18, 2016

(87) PCT Pub. No.: WO2017/219408
PCT Pub. Date: Dec. 28, 2017

(65) Prior Publication Data

US 2018/0182315 A1 Jun. 28, 2018

(51) Int. Cl.
*G09G 3/36* (2006.01)

(52) U.S. Cl.
CPC ..... *G09G 3/3607* (2013.01); *G09G 3/3648* (2013.01); *G09G 2300/0452* (2013.01); *G09G 2320/0295* (2013.01)

(58) Field of Classification Search
CPC ..... G09G 3/2003; G09G 2300/0452; G09G 3/36; G09G 3/3607; G09G 2320/0626; G09G 2320/0673
See application file for complete search history.

(56) References Cited

U.S. PATENT DOCUMENTS 7,277,075 B1 * 10/2007 Hirano ..... G09G 3/3607 345/690
2014/0225815 A1 * 8/2014 Jung ..... G09G 5/02 345/83
2017/0310956 A1 * 10/2017 Perdices-Gonzalez ..... H04N 13/366

* cited by examiner

*Primary Examiner* — Koosha Sharifi-Tafreshi
(74) *Attorney, Agent, or Firm* — Leong C. Lei

(57) ABSTRACT

The invention provides a data processing method for transparent LCD; which computes the grayscale value of the transparent sub-pixel based on the grayscale values of the red, green and blue sub-pixels of each display pixel. As such, the present invention realizes the real time adjustment of the transmittance of the transparent sub-pixel of the transparent LCD and effectively improves the display quality of the transparent LCD.

18 Claims, 2 Drawing Sheets

DATA PROCESSING METHOD FOR TRANSPARENT LIQUID CRYSTAL DISPLAY

BACKGROUND OF THE INVENTION

1. Field of the Invention

The present invention relates to the field of display, and in particular to a data processing method for transparent liquid crystal display.

2. The Related Arts

As the technology rapidly progresses and various new technologies emerge, the transparent display technology is gaining much attention due to the characteristics and unique application of the transparent display panel.

The transparent display panel refers to a display which is transparent so that the viewer can both see the images displayed by the display and the actual background behind the display. The transparent display has many applications, such as, window display for building or vehicles. Other than those large-area applications, the transparent display is also applicable to handheld devices, such as, viewing a map while also viewing the view behind the display.

The majority of current display market is estimated to be replaced by the transparent displays, for example, in building, advertisements, and public information applications. The transparent displays are categorized as head-up display (HUD), transparent liquid crystal display (LCD) and the transparent organic electroluminescent display. In these transparent displays, the HUD is implemented with image projection, while transparent LCD and the transparent organic electroluminescent display meet the true definition of transparent displays.

In known technology, the display pixel of the transparent LCD often comprises red, green and blue sub-pixels and a transparent sub-pixel; wherein the red, green and blue sub-pixels form an active area to provide the images for the viewer while the transparency sub-pixel in the state of the transparency allows the viewer to see the view behind through the display. Generally, the rotation of the liquid crystal (LC) corresponding to the transparent sub-pixel must be controlled independently. This is because, without independent control, the LC corresponding to the transparent sub-pixel will change as the signal of the pixel electrode changes, which in that the pixel having higher grayscale input signal will have higher transmittance, while the dark screen will have lowest transmittance, which does not meet the display requirement of transparent display. For a transparent display, the unimportant part of the image should have higher transmittance while the important part of the image should lower transmittance to highlight the display content for display effect. Therefore, it is desirable to provide a method so that the transmittance of the transparent sub-pixel is changeable in real time according to the display image.

SUMMARY OF THE INVENTION

The object of the present invention is to provide a data processing method for transparent LCD, able to adjust in real time the transmittance of the transparent area of the transparent LCD according to the color saturation, to improve the display effect of the transparent LCD.

To achieve the above object, the present invention provides a data processing method for transparent LCD, which comprises: Step 1: providing a transparent LCD, which comprising: a plurality of display pixels arranged in an array, with each display pixel comprising: a red sub-pixel, a green sub-pixel, a blue sub-pixel and a transparent sub-pixel; Step 2: providing grayscale values to the red sub-pixel, green sub-pixel and blue sub-pixel in each display pixel; Step 3: based on the grayscale values of the red sub-pixel, green sub-pixel and blue sub-pixel in each display pixel, computing the grayscale value of the transparent sub-pixel of each display pixel with the following equation:

$$T=(f(R,G,B)-a))^2/a+b;$$

wherein T being the grayscale value of the transparent sub-pixel of the display pixel, R being the grayscale value of the red sub-pixel of the display pixel, G being the grayscale value of the green sub-pixel of the display pixel, and B being the grayscale value of the blue sub-pixel of the display pixel; a and b being constants and greater than 0, f being a function of obtaining a value from R, G, and B, or a function of R, G, B with arithmetic operations, square and square root operation, the sum of a and b being smaller than or equal to 255, and $(255-a)^2/a+b\leq 255$; Step 4: based on the grayscale values of the red sub-pixel, green sub-pixel, blue sub-pixel and transparent sub-pixel of each display pixel, driving the red sub-pixel, green sub-pixel, blue sub-pixel and transparent sub-pixel of each display pixel for displaying.

In a preferred embodiment, a=128, and b=127.

The red sub-pixel, green sub-pixel, blue sub-pixel and transparent sub-pixel are of the same size.

The red sub-pixel, green sub-pixel and blue sub-pixel are of the same size, and the size of the transparent sub-pixel is different from the size of the red sub-pixel, green sub-pixel and blue sub-pixel.

The size of the transparent sub-pixel is equal to the sum of the size of the red sub-pixel, the size of the green sub-pixel and the size of the blue sub-pixel.

Each sub-pixel is driven by an independent thin film transistor (TFT) to display.

In a preferred embodiment, f is a function of obtaining the maximum of R, G and B.

In a preferred embodiment, f is a function of obtaining the minimum of R, G and B.

In a preferred embodiment, f is a function of obtaining the median of R, G and B.

In a preferred embodiment, f is a function of obtaining the average of R, G and B.

The present invention also provides a data processing method for transparent LCD, which comprises: Step 1: providing a transparent LCD, which comprising: a plurality of display pixels arranged in an array, with each display pixel comprising: a red sub-pixel, a green sub-pixel, a blue sub-pixel and a transparent sub-pixel; Step 2: providing grayscale values to the red sub-pixel, green sub-pixel and blue sub-pixel in each display pixel; Step 3: based on the grayscale values of the red sub-pixel, green sub-pixel and blue sub-pixel in each display pixel, computing the grayscale value of the transparent sub-pixel of each display pixel with the following equation:

$$T=(f(R,G,B)-a))^2/a+b;$$

wherein T being the grayscale value of the transparent sub-pixel of the display pixel, R being the grayscale value of the red sub-pixel of the display pixel, G being the grayscale value of the green sub-pixel of the display pixel, and B being the grayscale value of the blue sub-pixel of the display pixel; a and b being constants and greater than 0, f being a function of obtaining a value from R, G, and B, or a function of R, G, B with arithmetic operations, square and square root operation, the sum of a and b being smaller than or equal to 255, and $(255-a)^2/a+b\leq 255$; Step 4: based on the grayscale values of the red sub-pixel, green sub-pixel, blue sub-pixel and transparent sub-pixel of each display pixel, driving the red sub-pixel, green sub-pixel, blue sub-pixel and transparent sub-pixel of each display pixel for displaying; wherein a=128, and b=127; wherein each sub-pixel being driven by an independent thin film transistor (TFT) to display.

Compared to the known techniques, the present invention provides the following advantages: the present invention provides a data processing method for transparent LCD; which computes the grayscale value of the transparent sub-pixel based on the grayscale values of the red, green and blue sub-pixels of each display pixel. As such, the present invention realizes the real time adjustment of the transmittance of the transparent sub-pixel of the transparent LCD and effectively improves the display quality of the transparent LCD.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 1:
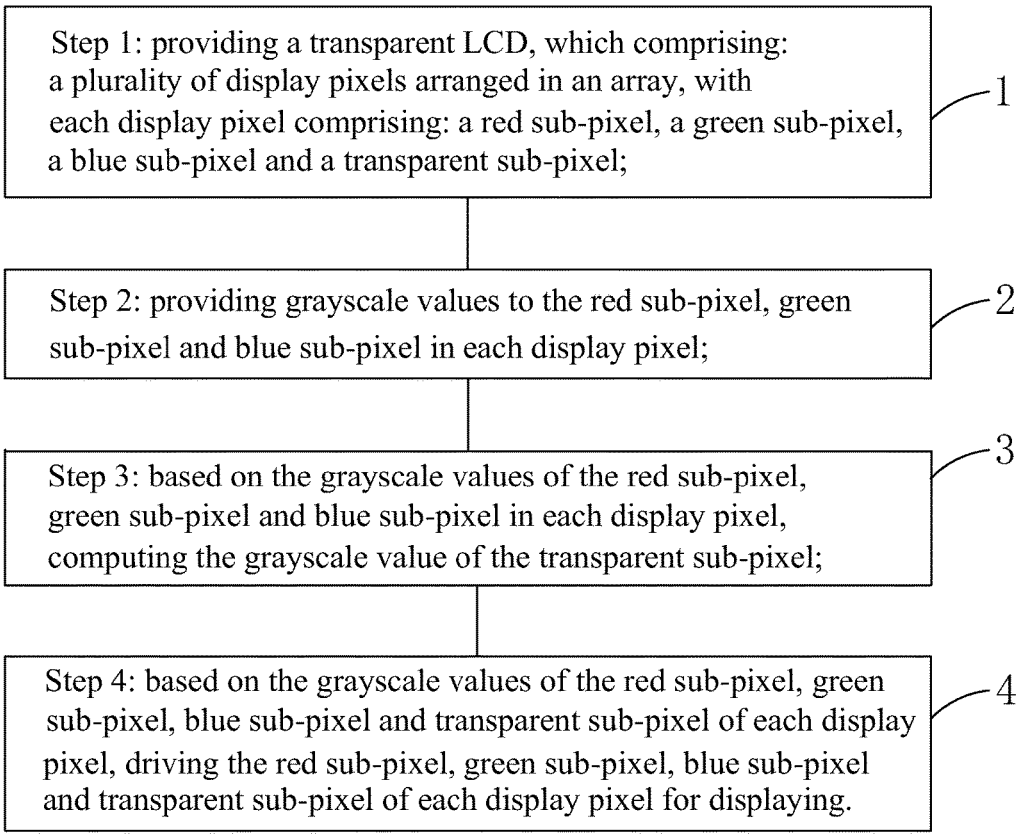
FIG. 1 is a schematic view showing the flowchart of the data processing method for transparent LCD provided by an embodiment of the present invention.
Figure 2:
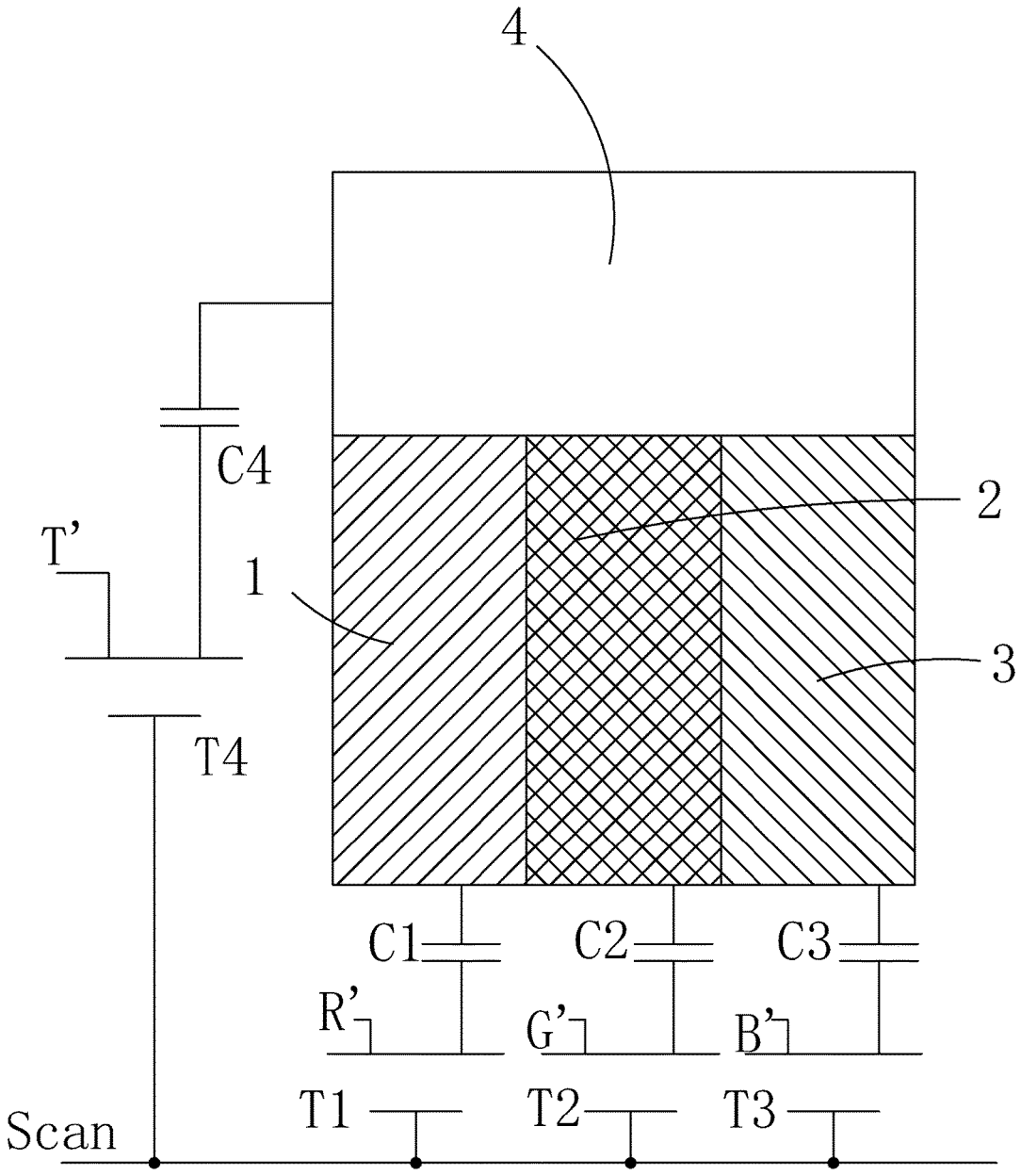
FIG. 2 is a schematic view showing a driver circuit of a display pixel of the data processing method for transparent LCD provided by the third embodiment of the present invention.

Refer to FIG. 1 and FIG. 2. The present invention provides a data processing method for transparent LCD, which comprises:

Step 1: providing a transparent LCD, which comprising: a plurality of display pixels arranged in an array, with each display pixel comprising: a red sub-pixel 1, a green sub-pixel 2, a blue sub-pixel 3 and a transparent sub-pixel 4.

Specifically, each of the red sub-pixel 1, green sub-pixel 2, blue sub-pixel 3 and transparent sub-pixel 4 is driven by an independent thin film transistor (TFT) to display. The TFT controls the pixel electrode voltage of each sub-pixel, leading to controlling the rotation of the LC corresponding to the sub-pixel. As shown in FIG. 2, four TFTs and four capacitors C1, C2, C3, C4 are disposed to correspond to a display pixel. The four TFTs defined as the first, second and fourth TFTs T1, T2, T3, T4, respectively, and the four capacitors are defined as the first, second, third and fourth capacitors C1, C2, C3, C4 respectively; wherein the gate of the first TFT T1 is connected to receive a scan signal Scan, the source is connected to receive a red sub-pixel driving signal R', and the drain is connected through the first capacitor C1 to the red sub-pixel 1; the gate of the second TFT T2 is connected to receive a scan signal Scan, the source is connected to receive a green sub-pixel driving signal G', and the drain is connected through the second capacitor C2 to the green sub-pixel 2; the gate of the third TFT T3 is connected to receive a scan signal Scan, the source is connected to receive a blue sub-pixel driving signal B', and the drain is connected through the third capacitor C3 to the blue sub-pixel 3; the gate of the fourth TFT T4 is connected to receive a scan signal Scan, the source is connected to receive a transparent sub-pixel driving signal T', and the drain is connected through the fourth capacitor C4 to the transparent sub-pixel 4.

Moreover, the sizes and arrangement of the red sub-pixel 1, green sub-pixel 2, blue sub-pixel 3 and transparent sub-pixel 4 can vary depending on the application. For example, the red sub-pixel 1, green sub-pixel 2, blue sub-pixel 3 and transparent sub-pixel 4 are all of the same size and arranged along the same direction successively; alternatively, the red sub-pixel 1, green sub-pixel 2, and blue sub-pixel 3 are of the same size, and the size of the transparent sub-pixel 4 is different from the size of the red sub-pixel 1, green sub-pixel 2 and blue sub-pixel 3, such as, the size of the transparent sub-pixel 4 is equal to the sum of the size of the red sub-pixel 1, the size of the green sub-pixel 2 and the size of the blue sub-pixel 3, and the transparent sub-pixel 4 is located above the red sub-pixel 1, green sub-pixel 2, and blue sub-pixel 3, while red sub-pixel 1, green sub-pixel 2, and blue sub-pixel 3 are arranged along the horizontal direction successively.

Step 2: providing grayscale values to the red sub-pixel 1, green sub-pixel 2 and blue sub-pixel 3 in each display pixel.

Step 3: based on the grayscale values of the red sub-pixel 1, green sub-pixel 2 and blue sub-pixel 3 in each display pixel, computing the grayscale value of the transparent sub-pixel 4 of each display pixel with the following equation:

$$T=(f(R,G,B)-a))^2/a+b;$$

wherein T being the grayscale value of the transparent sub-pixel 4 of the display pixel, R being the grayscale value of the red sub-pixel 1 of the display pixel, G being the grayscale value of the green sub-pixel 2 of the display pixel, and B being the grayscale value of the blue sub-pixel 3 of the display pixel.

Moreover, a and b are constants and greater than 0, the sum of a and b is smaller than or equal to 255, and $(255-a)^2/a+b\leq 255$. Preferably, a=128, and b=127.

Specifically, f is a function of obtaining a value from R, G, and B, for example, f is a function of obtaining the maximum of R, G and B, or obtaining the minimum of R, G and B, or obtaining the median of R, G and B.

Specifically, let f be the function of maximum of R, G and B, a=128, and b=127. At this point, $T=((\max(R,G,B)-128)^2/128+127$. Based on the curve of a quadratic function, the change in T with respect to the function max(R, G, B) is a parabola opening upward. In other words, for the transparent LCD, when the color saturation of a display pixel is higher or lower, the transmittance of the transparent sub-pixel 4 of the display pixel is increased. When the color saturation of a display pixel is in the middle range, the transmittance of the transparent sub-pixel 4 of the display pixel is reduced.

Also, f can be a function of R, G, B with arithmetic operations, square and square root operation, for example, f is a function of obtaining the average of R, G and B.

Specifically, let f be the function of average of R, G and B, a=128, and b=127. At this point, $T=((\max(R,G,B)-128)^2/128+127$. Based on the curve of a quadratic function, the change in T with respect to the function average(R, G, B) is a parabola opening upward. In other words, for the transparent LCD, when the color saturation of a display pixel is higher or lower, the transmittance of the transparent sub-pixel 4 of the display pixel is increased. When the color saturation of a display pixel is in the middle range, the transmittance of the transparent sub-pixel 4 of the display pixel is reduced.

Step 4: based on the grayscale values of the red sub-pixel 1, green sub-pixel 2, blue sub-pixel 3 and transparent sub-pixel 4 of each display pixel, driving the red sub-pixel 1, green sub-pixel 2, blue sub-pixel 3 and transparent sub-pixel 4 of each display pixel for displaying.

Specifically, the driving signals R', G', B', T' respectively for the red sub-pixel 1, green sub-pixel 2, blue sub-pixel 3 and transparent sub-pixel 4 are generated based on the grayscale values of the red sub-pixel 1, green sub-pixel 2, blue sub-pixel 3 and transparent sub-pixel 4 of each display pixel, and then the present invention uses the driving signals to drive the red sub-pixel 1, green sub-pixel 2, blue sub-pixel 3 and transparent sub-pixel 4 to display accordingly.

In summary, the present invention provides a data processing method for transparent LCD; which computes the grayscale value of the transparent sub-pixel based on the grayscale values of the red, green and blue sub-pixels of each display pixel. As such, the present invention realizes the real time adjustment of the transmittance of the transparent sub-pixel of the transparent LCD and effectively improves the display quality of the transparent LCD.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A data processing method for transparent liquid crystal display (LCD), which comprises:

Step 1: providing a transparent LCD, which comprising: a plurality of display pixels arranged in an array, with each display pixel comprising:

a red sub-pixel, a green sub-pixel, a blue sub-pixel and a transparent sub-pixel;

Step 2: providing grayscale values to the red sub-pixel, green sub-pixel and blue sub-pixel in each display pixel;

Step 3: based on the grayscale values of the red sub-pixel, green sub-pixel and blue sub-pixel in each display pixel, computing the grayscale value of the transparent sub-pixel of each display pixel with the following equation:

$$T=(f(R,G,B)-a))^2/a+b;$$

wherein T being the grayscale value of the transparent sub-pixel of the display pixel, R being the grayscale value of the red sub-pixel of the display pixel, G being the grayscale value of the green sub-pixel of the display pixel, and B being the grayscale value of the blue sub-pixel of the display pixel; a and b being constants and greater than 0, f being a function of obtaining a value from R, G, and B, or a function of R, G, B with arithmetic operations, square and square root operation;

the sum of a and b being smaller than or equal to 255, and $(255-a)^2/a+b\leq 255$;

Step 4: based on the grayscale values of the red sub-pixel, green sub-pixel, blue sub-pixel and transparent sub-pixel of each display pixel, driving the red sub-pixel, green sub-pixel, blue sub-pixel and transparent sub-pixel of each display pixel for displaying.

2. The data processing method for transparent LCD as claimed in claims 1, a=128, and b=127.

3. The data processing method for transparent LCD as claimed in claim 1, wherein the red sub-pixel, green sub-pixel, blue sub-pixel and transparent sub-pixel are of the same size.

4. The data processing method for transparent LCD as claimed in claim 1, wherein the red sub-pixel, green sub-pixel and blue sub-pixel are of the same size, and the size of the transparent sub-pixel is different from the size of the red sub-pixel, green sub-pixel and blue sub-pixel.

5. The data processing method for transparent LCD as claimed in claim 4, wherein the size of the transparent sub-pixel is equal to the sum of the size of the red sub-pixel, the size of the green sub-pixel and the size of the blue sub-pixel.

6. The data processing method for transparent LCD as claimed in claim 1, wherein each sub-pixel is driven by an independent thin film transistor (TFT) to display.

7. The data processing method for transparent LCD as claimed in claim 1, wherein f is a function of obtaining the maximum of R, G and B.

8. The data processing method for transparent LCD as claimed in claim 1, wherein f is a function of obtaining the minimum of R, G and B.

9. The data processing method for transparent LCD as claimed in claim 1, wherein f is a function of obtaining the median of R, G and B.

10. The data processing method for transparent LCD as claimed in claim 1, wherein f is a function of obtaining the average of R, G and B.

11. A data processing method for transparent liquid crystal display (LCD), which comprises:

Step 1: providing a transparent LCD, which comprising: a plurality of display pixels arranged in an array, with each display pixel comprising: a red sub-pixel, a green sub-pixel, a blue sub-pixel and a transparent sub-pixel;

Step 2: providing grayscale values to the red sub-pixel, green sub-pixel and blue sub-pixel in each display pixel;

Step 3: based on the grayscale values of the red sub-pixel, green sub-pixel and blue sub-pixel in each display pixel, computing the grayscale value of the transparent sub-pixel of each display pixel with the following equation:

$$T=(f(R,G,B)-a))^2/a+b;$$

wherein T being the grayscale value of the transparent sub-pixel of the display pixel, R being the grayscale value of the red sub-pixel of the display pixel, G being the grayscale value of the green sub-pixel of the display pixel, and B being the grayscale value of the blue sub-pixel of the display pixel; a and b being constants and greater than 0, f being a function of obtaining a value from R, G, and B, or a function of R, G, B with arithmetic operations, square and square root operation;

the sum of a and b being smaller than or equal to 255, and $(255-a)^2/a+b \leq 255$;

Step 4: based on the grayscale values of the red sub-pixel, green sub-pixel, blue sub-pixel and transparent sub-pixel of each display pixel, driving the red sub-pixel, green sub-pixel, blue sub-pixel and transparent sub-pixel of each display pixel for displaying;

wherein a=128, and b=127;

wherein each sub-pixel being driven by an independent thin film transistor (TFT) to display.

12. The data processing method for transparent LCD as claimed in claim 11, wherein the red sub-pixel, green sub-pixel, blue sub-pixel and transparent sub-pixel are of the same size.

13. The data processing method for transparent LCD as claimed in claim 11, wherein the red sub-pixel, green sub-pixel and blue sub-pixel are of the same size, and the size of the transparent sub-pixel is different from the size of the red sub-pixel, green sub-pixel and blue sub-pixel.

14. The data processing method for transparent LCD as claimed in claim 13, wherein the size of the transparent sub-pixel is equal to the sum of the size of the red sub-pixel, the size of the green sub-pixel and the size of the blue sub-pixel.

15. The data processing method for transparent LCD as claimed in claim 11, wherein f is a function of obtaining the maximum of R, G and B.

16. The data processing method for transparent LCD as claimed in claim 11, wherein f is a function of obtaining the minimum of R, G and B.

17. The data processing method for transparent LCD as claimed in claim 11, wherein f is a function of obtaining the median of R, G and B.

18. The data processing method for transparent LCD as claimed in claim 11, wherein f is a function of obtaining the average of R, G and B.

* * * * *